US006428420B1

(12) United States Patent
Durnell

(10) Patent No.: US 6,428,420 B1
(45) Date of Patent: Aug. 6, 2002

(54) PUTTING PRACTICE APPARATUS

(76) Inventor: Grant Durnell, 2 Cecil Road, Chadwell Heath, Essex RM6 6LA (GB)

( * ) Notice: Subject to any disclaimer, the term of this patent is extended or adjusted under 35 U.S.C. 154(b) by 0 days.

(21) Appl. No.: 09/569,633

(22) Filed: May 12, 2000

(51) Int. Cl.[7] ..... A63B 69/36
(52) U.S. Cl. ..... 473/162; 473/163
(58) Field of Search ..... 473/157–164, 473/166, 171, 174–189

(56) References Cited

U.S. PATENT DOCUMENTS

| | | | | | |
|---|---|---|---|---|---|
| 1,761,039 | A | | 6/1930 | Hazeltine | |
| D83,498 | S | | 3/1931 | Carter | |
| 3,727,917 | A | | 4/1973 | Maclean | |
| 3,735,988 | A | * | 5/1973 | Palmer et al. | 473/162 |
| 3,843,136 | A | * | 10/1974 | Buenzle | 473/162 |
| 3,871,661 | A | | 3/1975 | Korff | |
| 4,850,594 | A | * | 7/1989 | Manzione | 473/162 |
| 5,002,280 | A | | 3/1991 | Hines | |
| 5,042,813 | A | * | 8/1991 | Huang | 473/153 |
| 5,100,145 | A | | 3/1992 | Kim | |
| 5,102,141 | A | * | 4/1992 | Jordan | 473/163 |
| 5,171,016 | A | * | 12/1992 | Kamal | 473/160 |
| 5,306,009 | A | * | 4/1994 | Bolanos | 473/157 |
| 5,366,224 | A | * | 11/1994 | Stanwyck et al. | 473/473 |
| 5,863,256 | A | * | 1/1999 | MacLean et al. | 473/160 |

* cited by examiner

*Primary Examiner*—Mark S. Graham

(57) ABSTRACT

A putting practice apparatus for practicing putting a golf ball on sloped surfaces. The putting practice apparatus includes a plurality of base members being detachably connected end-to-end to form a continuous artificial putting green upon which a user can practice one's putting with each of the base members having a front end, a back end, sides, a top surface with the top surfaces of the base, members being contoured uniquely relative to one another with at least one of the base members,including a hole disposed in the top surface thereof and being adapted to receive a golf ball; and also includes a cover removably and securely disposed upon the top surfaces of the base members; and further includes a ball return assembly for returning a ball from said hole to the user.

3 Claims, 2 Drawing Sheets

PUTTING PRACTICE APPARATUS

BACKGROUND OF THE INVENTION

1. Field of the Invention

The present invention relates to a putting green apparatus and more particularly pertains to a new putting practice apparatus for practicing putting a golf ball on sloped surfaces.

2. Description of the Prior Art

The use of a putting green apparatus is known in the prior art. More specifically, a putting green apparatus heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,727,917; U.S. Pat. No. 5,100,145; U.S. Pat. No. 5,002,280; U.S. Pat. No. 3,871,661; U.S. Pat. No. 1,761,039; and U.S. Pat. No. Des. 83,498.

While these devices fulfill their respective, particular objectives and requirements, the aforementioned patents do not disclose a new putting practice apparatus. The inventive device includes a plurality of base members being detachably connected end-to-end to form a continuous artificial putting green upon which a user can practice one's putting with each of the base members having a front end, a back end, sides, a top surface with the top surfaces of the base members being contoured uniquely relative to one another with at least one of the base members including a hole disposed in the top surface thereof and being adapted to receive a golf ball; and also includes a cover removably and securely disposed upon the top surfaces of the base members with the cover being adapted to allow a user to practice one's putting thereupon with the cover including a back end and a front end; and further includes a fastening assembly for fastening the cover upon the base members; and further includes a ball return assembly for returning a ball from said hole to the user.

In these respects, the putting practice apparatus according to the present invention substantially departs from the conventional concepts and designs of the prior art, and in so doing provides an apparatus primarily developed for the purpose of practicing putting a golf ball on sloped surfaces.

SUMMARY OF THE INVENTION

In view of the foregoing disadvantages inherent in the known types of putting green apparatus now present in the prior art, the present invention provides a new putting practice apparatus construction wherein the same can be utilized for practicing putting: a golf ball on sloped surfaces.

The general purpose of the present invention, which will be described subsequently in greater detail, is to provide a new putting practice apparatus which has many of the advantages of the putting green apparatus mentioned heretofore and many novel features that result in a new putting practice apparatus which is not anticipated, rendered obvious, suggested, or even implied by any of the prior art putting green apparatus, either alone or in any combination thereof.

To attain this, the present invention generally comprises a plurality of base members being detachably connected end-to-end to form a continuous artificial putting green upon which a user can practice one's putting with each of the base members having a front end, a back end, sides, a top surface with the top surfaces of the base members being contoured uniquely relative to one another with at least one of the base members including a hole disposed in the top surface thereof and being adapted to receive a golf ball; and also includes a cover removably and securely disposed upon the top surfaces of the base members with the cover being adapted to allow a user to practice one's putting thereupon with the cover including a back end and a front end; and further includes a fastening assembly for fastening the cover upon the base members; and further includes a ball return assembly for returning a ball from said hole to the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures; methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new putting practice apparatus which has many of the advantages of the putting green apparatus mentioned heretofore and many novel features that result in a new putting practice apparatus which is not anticipated, rendered obvious, suggested, or even implied by any of the prior art putting green apparatus, either alone or in any combination thereof.

It is another object of the present invention to provide a new putting practice apparatus which may be easily and efficiently manufactured and marketed.

It is a further object of the present invention to provide a new putting practice apparatus which is of a durable and reliable construction.

An even further object of the present invention is to provide a new putting practice apparatus which is susceptible of a low cost of manufacture with regard to both materials and labor, and which accordingly is then susceptible of low prices of sale to the consuming public, thereby making such putting practice apparatus economically available to the buying public.

Still yet another object of the present invention is to provide a new putting practice apparatus which provides in the apparatuses and methods of the prior art some of the advantages thereof, while simultaneously overcoming some of the disadvantages normally associated therewith.

Still another object of the present invention is to provide a new putting practice apparatus for practicing putting a golf ball on sloped surfaces.

Yet another object of the present invention is to provide a new putting practice apparatus which includes a plurality of base members being detachably connected end-to-end to form a continuous artificial putting green upon which a user can practice one's putting with each of the base members having a front end, a back end, sides, a top surface with the top surfaces of the base members being contoured uniquely relative to one another with at least one of the base members including a hole disposed in the top surface thereof and being adapted to receive a golf ball; and also includes a cover removably and securely disposed upon the top surfaces of the base members with the cover being adapted to allow a user to practice one's putting thereupon with the cover including a back end and a front end; and further includes a fastening assembly for fastening the cover upon the base members; and further includes a ball return assembly for returning a ball from said hole to the user.

Still yet another object of the present invention is to provide a new putting practice apparatus that is easy and convenient to set up and use anywhere and that actually returns the ball once it it putted in the hole.

Even still another object of the present invention is to provide a new putting practice apparatus that allows for the user to effectively and easily lengthen and shorten the putting as desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED-EMBODIMENT

Figure 1:
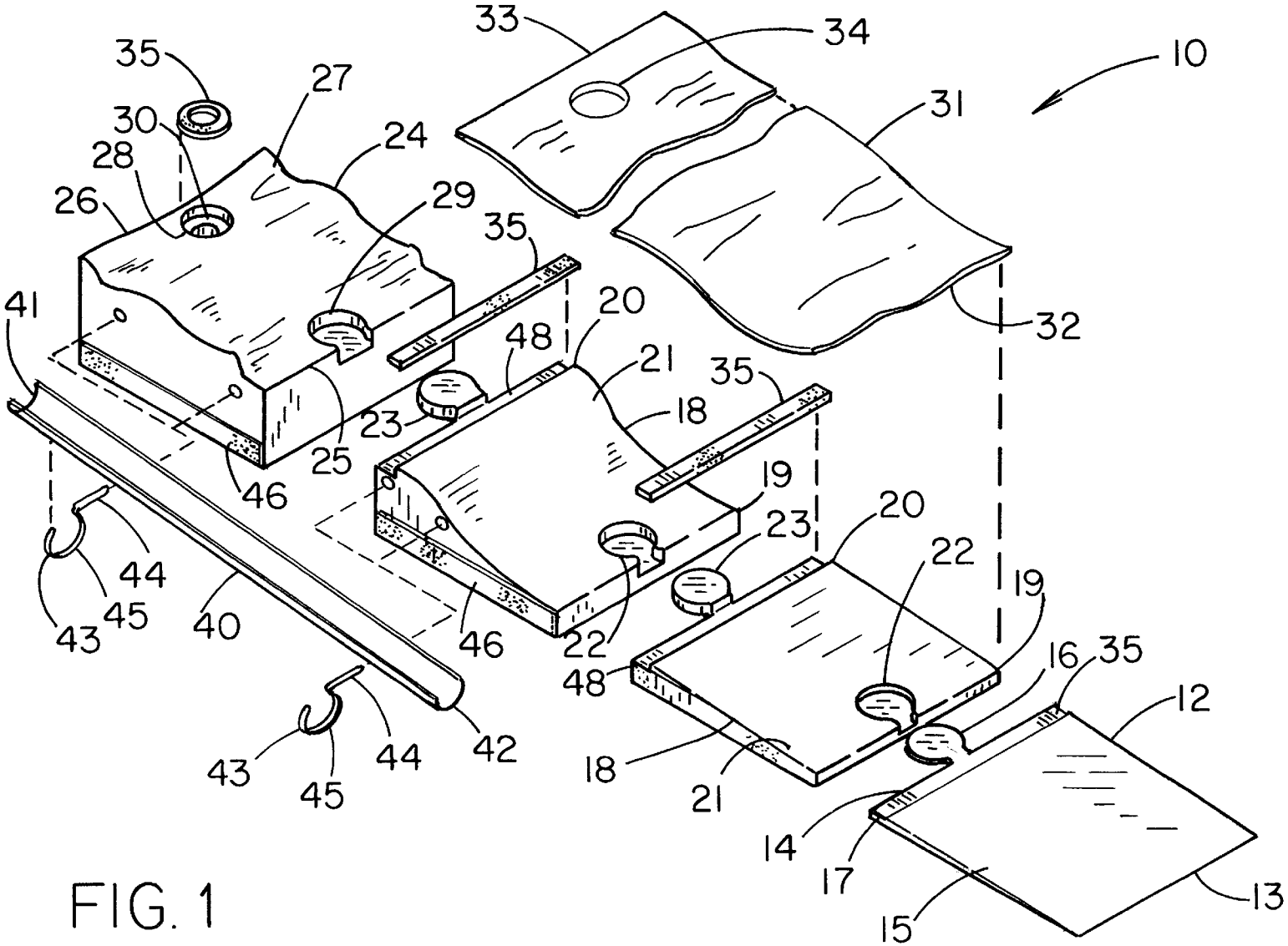
FIG. 1 is an exploded perspective view of a new putting practice apparatus according to the present invention.
Figure 2:
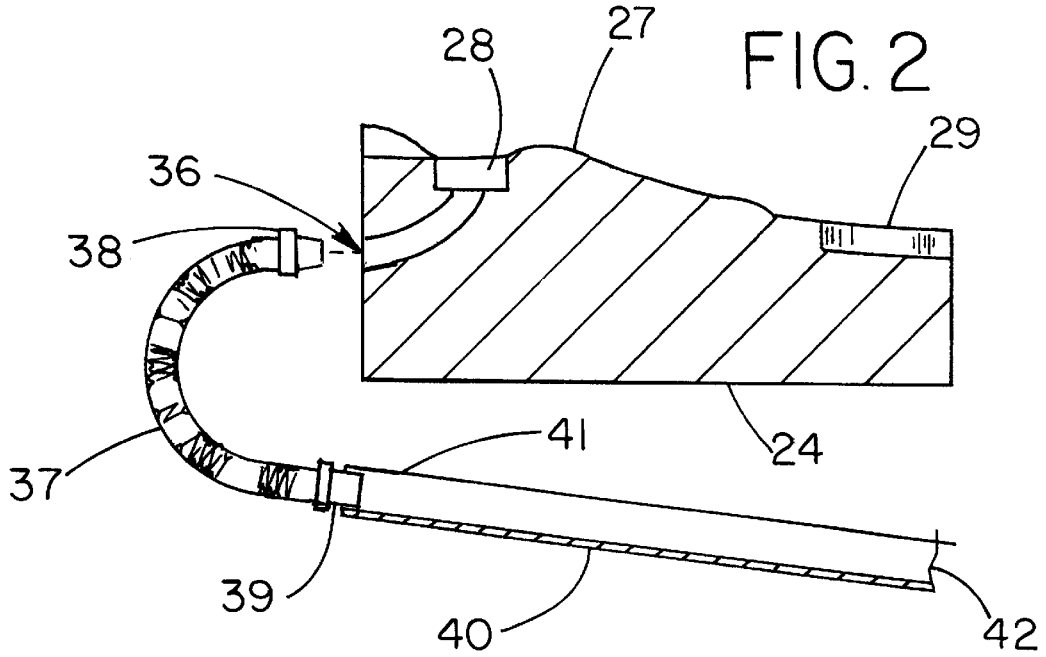
FIG. 2 is a detailed cross-sectional view of the last base member and the ball return means of the present invention.
Figure 3:
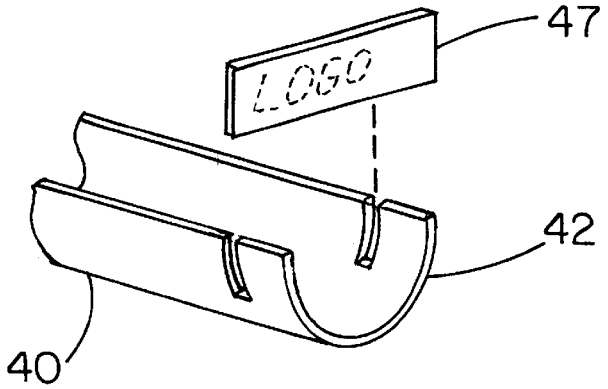
FIG. 3 is a detailed perspective view of the second end of the trough including the ball stop member of the present invention.
Figure 4:
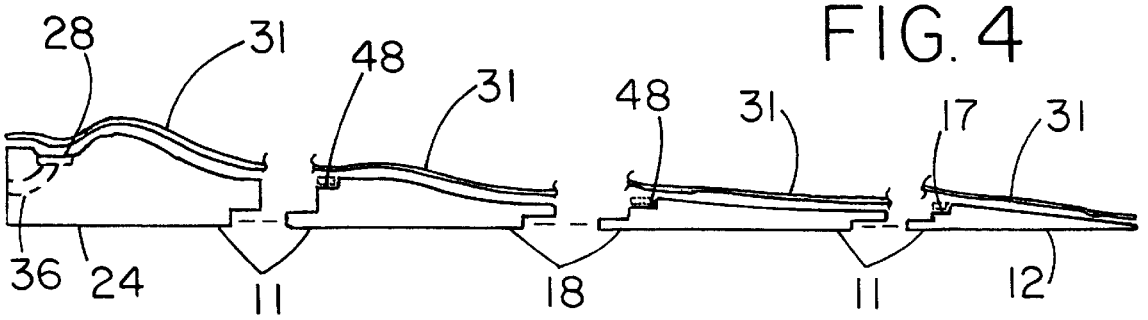
FIG. 4 is an exploded side elevational view of the present invention.

With reference now to the drawings, and in particular to FIGS. 1 through 4 thereof, a new putting practice apparatus embodying the principles and concepts of the present invention and generally designated by-the reference numeral 10 will be described.

As best illustrated in FIGS. 1 through 4, the putting practice apparatus 10 generally comprises a plurality of base members 11 being detachably connected end-to-end to form a continuous artificial putting green upon which a user can practice one's putting. Each of the base members 11 has a front end 13,19,25, a back end 14,20,26, sides, a top surface 15,21,27 with the top surfaces 15,21,27 of the base members 11 being contoured uniquely relative to one another. At least one of the base members 24 includes a hole 28 disposed in the top surface 27 thereof and being adapted to receive a golf ball. The base members 11 include a first base member 12 having a first connecting member 16 integrally extending from the back end 14 of the first base member 12 and further having a recessed portion 17 disposed at the back end 14 of the first base member 12. The base members 11 also include a plurality of intermediate base members 18 each having a connecting member slot 22 disposed in a respective top surface 21 at a respective front end 19 thereof with each of the intermediate base members 18 also having a base, connecting member 23 integrally extending from a respective back end 20 thereof, and each of the intermediate base members 18 further having, a recessed portion 48 disposed in a respective top surface 21 at a respective back end 20 thereof. The base members 11 include a last base member 24 having a last connecting member slot 29 disposed in the top surface 27 at the front end 25 thereof with the hole 28 being disposed in the top surface 27 thereof near the back end 26 thereof. The first connecting member 16 is removably and securely received in the connecting member slot 22 of one of the intermediate base members 18. The base connecting member 23 of one of the intermediate base members 18 is removably and securely received in the last connecting member slot 29 of the last base member 24 with the intermediate base members 18 being removably connected end-to-end to form the continuous putting green. The top surfaces 15,21,27 of the base members 11 are elevated relative to one another with one of the base members 24 having a top surface 27 which is disposed higher than the top surfaces 15,21 of the other base members 12,18, and with another of the base members 12 having a top surface 15 which is disposed lower than the top surfaces 21,27 of the other base members 18,24. The last base member 24 includes a bore 36 extending through the hole 28 and through a back wall thereof with the bore 36 being adapted to allow a golf ball-to pass therethrough and with the bore 36 having a circumference relatively smaller than the circumference of the hole 28 thus forming an annular recessed portion 30 in the hole 28. Each of the base members 11 has a width of approximately 3 feet and a height ranging from 1 inch to 12 inches with the putting green having a length of approximately 12 feet.

A cover 31 is removably and securely disposed upon the top surfaces 15,21,27 of the base members 11 with the cover 31 being adapted to allow a user to practice one's putting thereupon. The cover 31 includes a back end 33 and a front end 32. The cover 31 also includes an opening 34 extending therethrough near the back end 33 thereof with the opening 34 being in alignment with the hole 28 in the last base member 24 upon the cover 31 being securely fastened upon the top surfaces 15,21,27 of the base members 11. The cover 31 is essentially artificial grass.

A means for removably fastening the cover 31 upon the base members 11 includes strips 35,46 of hook and loop fasteners some of which are securely attached in a respective recessed portion 17,48 of the base members 11 and to a portion of a bottom side of the cover 31 and in the annular recessed portion 30 of the hole 28 in the last base member 24, and some of which are securely attached to the side of the base members 11.

A ball return means for returning a ball from the hole 28 to the user includes a flexible tubular member 37 having a first end 38 removably and conventionally received in the bore 36 through the back wall of the last base member 24, and also includes a trough 40 having a first end 41 conventionally connected to a second end 39 of the flexible tubular member 37, and further includes a golf ball stop 47 removably and conventionally disposed in the trough 40 near a second end 42 thereof, and further includes means for mounting the trough 40 to the base members 11. The trough 40 is removably and securely mounted to a side of the base members 11.

The means for mounting the trough 40 to the base members 11 includes bracket members 43 each of which includes a stem portion 44 and an arcuate portion 45 with the stem portion 44 being removably extended in a the side of a respective the base member 12,18,24 and with the arcuate portion 45 being adapted to receive and support the trough 40 thereupon.

In use, the user connects the-base members 11 together and fastens the cover 31 on the top surfaces 15,21,27 and connects the flexible tubular member 37 to the bore 36 in the back wall of the last base member 24 and connects the trough 40 to the flexible tubular member 37 and mounts the trough 40 to the side of the base members 11 such that the golf ball will roll along the trough 40 back to the user after the user putted the golf ball in the hole 28 starting from atop the first base member 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents, may be resorted to, falling-within the scope of the invention.

I claim:

1. A putting practice apparatus comprising:

a plurality of base members being detachably connected end-to-end to form a continuous artificial putting green upon which a user can practice one's putting, each of said base members having a front end, a back end, sides, a top surface, said top surfaces of said base members being contoured uniquely relative to one another, at least one of said base members including a hole disposed in said top surface thereof and being adapted to receive a golf ball;

a cover removably and securely disposed upon said top surfaces of said base members, said cover being adapted to allow a user to practice one's putting thereupon, said cover including a back end and a front end;

a means for removably fastening said cover upon said base members; and a ball return means for returning a ball from said hole to the user;

wherein said base members include a first base member having a first connecting member integrally extending from said back end of said first base member and further having a recessed portion disposed at said front end of said first base member;

wherein said base members include a plurality of intermediate base members each having a connecting member slot disposed in a respective said top surface at a respective said front end thereof, each of said intermediate base members also having a base connecting member integrally extending from a respective said back end thereof, and each of said intermediate base members further having a recessed portion disposed in a respective said top surface at a respective said back end thereof;

wherein said base members include a last base member having a last connecting member slot disposed in said top surface at said front end thereof, said hole being disposed in said top surface thereof near said back end thereof, said first connecting member being removably and securely received in said connecting member slot of one of said intermediate base members, said base connecting member of one of said intermediate base members being removably and securely received in said last connecting member slot of said last base member with said intermediate base members being removably connected end-to-end to form the continuous putting green;

wherein said top surfaces of said base members are elevated relative to one another with one of said base members having said top surface which is disposed higher than said top surfaces of the other said base members and with one of said base members having said top surface which is disposed lower than said top surfaces of the other of said base members;

wherein said last base member includes a bore extending through said hole and through a back wall thereof, said bore being adapted to allow a golf ball to pass therethrough, said bore having a circumference relatively smaller than said circumference of said hole thus forming an annular recessed portion in said hole;

wherein said cover includes an opening extending therethrough near said back end thereof, said opening being in alignment with said hole in said last base member upon said cover being securely fastened upon said top surfaces of said base members;

wherein said cover is essentially artificial grass;

wherein said means for removably fastening said cover upon said base members includes a plurality of strips of hook and loop fasteners some of which is securely attached in a respective said recessed portion of said base members and to a portion of a bottom side of said cover and in said annular recessed portion of said hole and some of which are securely attached to a side of said base members;

wherein said ball return means includes a flexible tubular member having a first end removably received in said bore through said back wall of said last base member, and also includes a trough having a first end connected to a second end of said flexible tubular member, and further includes a golf ball stop removably disposed in said trough near a second end thereof, said trough being removably and securely mounted to the side of said base members, and further includes means for mounting said trough to said base members.

2. A putting practice apparatus as described in claim 1, wherein said means for mounting said trough to said base members includes bracket members each of which includes a stem portion and an arcuate portion, said stem portion being removably extended in a said side of a respective said base member, said arcuate portion being adapted to receive and support said trough thereupon.

3. A putting practice apparatus comprising:

a plurality of base members being detachably connected end-to-end to form a continuous artificial putting green upon which a user can practice one's putting, each of said base members having a front end, a back end, sides, a top surface, said top surfaces of said base members being contoured uniquely relative to one another, at least one of said base members including a hole disposed in said top surface thereof and being adapted to receive a golf ball, said base members including a first base member having a first connecting member integrally extending from said back end of said first base member and further having a recessed portion disposed at said front end of said first base member, said base members including a plurality of intermediate base members each having a connecting member slot disposed in a respective said top surface at a respective said front end thereof, each of said intermediate base members also having a base connecting member integrally extending from a respective said back end thereof, and each of said intermediate base members further having a recessed portion disposed in a respective said top surface at a respective said back end thereof, said base members including a last base member having a last connecting member slot disposed in said top surface at said front end thereof, said hole being disposed in said top surface thereof near said back end thereof, said first connecting member being removably and securely received in said connecting member slot of one of said intermediate base members, said base connecting member of one of said intermediate base members being removably and securely received in said last connecting member slot of said last base member with said intermediate base members being removably connected end-to-end to form the continuous putting green, said top surfaces of said base members being elevated relative to one another with one of said base members having said top surface which is disposed higher than said top surfaces of the other said base members and with another of said base members having said top surface which is disposed lower than said top surfaces of the other of said base members, said last base member including a bore extending through said hole and through a back wall thereof, said bore being adapted to allow a golf ball to pass therethrough, said bore having a circumference relatively smaller than said circumference of said hole thus forming an annular recessed portion in said hole, each of said base member having a width of approximately 3 feet and having a height ranging from 1 inch to 12 inches, said putting green having a length of approximately 12 feet;

a cover removably and securely disposed upon said top surfaces of said base members, said cover being adapted to allow a user to practice one's putting thereupon, said cover including a back end and a front end, said cover including an opening extending therethrough near said back end thereof, said opening being in alignment with said hole in said last base member upon said cover being securely fastened upon said to surfaces of said base members, said cover being essentially artificial grass;

a means for removably fastening said cover upon said base members including a plurality of strips of hook and loop fasteners some of which are securely attached in a respective said recessed portion of said base members and to a portion of a bottom side of said cover and in said annular recessed portion of said hole and some of which are securely attached to a side of said base members; and a ball return means for returning a ball from said hole to the user including a flexible tubular member having a first end removably received in said bore through said back wall of said last base member, and also including a trough having a first end connected to a second end of said flexible tubular member, and further including a golf ball stop removably disposed in said trough near a second end thereof, said trough being removably and securely mounted to the side of said base members, and further including means for mounting said trough to said base members, said means for mounting said trough to said base members including bracket members each of which includes a stem portion and an arcuate portion, said stem portion being removably extended in a said side of a respective said base member, said arcuate portion being adapted to receive and support said trough thereupon.

* * * * *